United States Patent [19]

Hayes, Jr.

[11] 4,407,137

[45] Oct. 4, 1983

[54] FAST DEFROST HEAT EXCHANGER

[75] Inventor: Richmond S. Hayes, Jr., Fayetteville, N.Y.

[73] Assignee: Carrier Corporation, Syracuse, N.Y.

[21] Appl. No.: 244,412

[22] Filed: Mar. 16, 1981

[51] Int. Cl.[3] ..... F25D 21/00

[52] U.S. Cl. ..... 62/80; 62/151; 62/525; 62/198

[58] Field of Search ..... 62/151, 525, 152, 80, 62/198, 199, 197, 89

[56] References Cited

U.S. PATENT DOCUMENTS

| | | | |
|---|---|---|---|
| 3,142,970 | 8/1964 | Hale | 62/324 |
| 3,150,501 | 9/1964 | Moore | 62/174 |
| 3,289,428 | 12/1966 | Haines | 62/149 |
| 3,529,659 | 9/1970 | Trask | 165/29 |
| 3,631,873 | 6/1972 | Swithenbank | 62/324 |
| 3,731,497 | 5/1973 | Ewing | 62/160 |
| 4,057,975 | 11/1977 | Del Toro et al. | 62/324 |
| 4,057,977 | 11/1977 | Chambless | 62/324 |
| 4,089,368 | 5/1978 | Bell, Jr. | 165/139 |

FOREIGN PATENT DOCUMENTS

| | | | |
|---|---|---|---|
| 549846 | 3/1931 | Fed. Rep. of Germany | 62/198 |

*Primary Examiner*—Albert J. Makay
*Assistant Examiner*—Henry Bennett
*Attorney, Agent, or Firm*—Donald F. Daley; Robert P. Hayter

[57] ABSTRACT

A method and apparatus for promoting effective heat transfer between refrigerant flowing through a heat exchanger and air flowing thereover and for providing a method of defrost of a portion of the heat exchanger wherein frost has accumulated. A headering arrangement is provided such that during defrost a portion of the heat exchanger is isolated and the fluid being supplied to the frosted portions of the coil is directed to the frosted portions to make the most effective use of the heat energy therein. Valve means are provided for regulating the flow of refrigerant to an intermediate header during defrost.

11 Claims, 3 Drawing Figures

FAST DEFROST HEAT EXCHANGER

BACKGROUND OF THE INVENTION

1. Field of the Invention

This invention relates to a heat exchanger assembly and method of operation appropriate for use with a frost accumulating heat exchanger. More particularly, the present invention relates to a multi-row heat exchanger wherein the frost accumulates primarily on a single row and means are provided for routing refrigerant during defrost to that single row.

2. Prior Art

In many air conditioning and refrigeration applications a heat exchanger is used under conditions wherein water is deposited on the heat exchanger surfaces. For example, the outdoor heat exchanger of a heat pump operating in the heating mode serves as an evaporator absorbing heat energy from ambient air being circulated thereover. As the ambient air temperature is decreased its ability to hold water vapor is additionally decreased and excess condensed water vapor will be deposited on the heat exchange surface as water. If this surface is below freezing, ice will accumulate and the heat transfer efficiency between air and the heat exchanger will be diminished. In addition, if it is raining or snowing, this moisture may be drawn into the heat exchanger by its air handling apparatus or forced on to the heat exchanger by the wind.

In a cold room or other applications where an evaporator is operating below freezing to cool the air being supplied to the room a similar problem may occur. The reduction in temperature of the air being circulated over the heat exchanger below its dew point acts to condense out moisture which may freeze on the coil surfaces impeding heat transfer.

Most heat pump systems include means for eliminating frost from the coil surface. One of the most common means of defrost is to reverse the heat pump placing the heat pump system in the cooling mode wherein heat energy is discharged to the outdoor coil then serving as a condenser. Heat energy is supplied by the hot gas from the compressor being circulated to the outdoor heat exchanger wherein it serves to raise the temperature of the heat exchanger and to melt the frost accumulated thereon.

It has been found in multi-row heat exchangers that the frost buildup accumulates primarily on the first row of the coil. As used herein, the first row of the coil will mean that row which the ambient air flows over first as it enters the coil, the row that first reduces the temperature of said air. The condensate from the air as it is cooled collects primarily on the first row of the coil and allows the inner rows of the coil to be substantially unaffected by frost accumulation. As the frost accumulates it builds up on the first row of the coil not only effecting heat transfer between refrigerant flowing through the heat exchanger and air flowing thereover but actually may impede air flow between the heat transfer surfaces.

Under some frost conditions it has been found that the bottom rows of an inner row of the heat exchanger accumulates frost as well as the first row of the coil.

In order to effectively direct hot gaseous refrigerant to the location where the frost has accumulated the present invention provides for a heat exchanger assembly having the appropriate flow circuiting such that when the heat exchanger is in the defrost mode hot gaseous refrigerant is supplied directly to the coil areas having the frost accumulated thereon. The remaining coil areas substantially unaffected by frost are isolated such that heat energy is not used to heat the non-iced coil rows.

SUMMARY OF THE INVENTION

It is therefore an object of the present invention to provide a heat exchanger assembly effective to transfer heat energy between refrigerant flowing therethrough and air flowing thereover.

It is another object of the present invention to provide a headering arrangement wherein during defrost hot gaseous refrigerant may be directed to that portion of the coil wherein frost has accumulated.

It is a further object of the present invention to provide a heat exchanger subassembly wherein during defrost the frost free portions of the coil are isolated from the hot gaseous refrigerant being supplied to the frosted areas for the melting of ice buildup.

It is another object of the present invention to provide a heat exchanger which may be safely and efficiently assembled and acts to provide the advantages of directing hot gaseous refrigerant to the frosted area during defrost.

These and other objects of the present invention are achieved by using a multi-row heat exchanger wherein the first coil row is positioned to receive the ambient air as it enters the unit. Hence the first coil row has most of the frost accumulate thereon. The second coil row as well as subsequent coil rows are located downstream from the first coil row and effectively have little or no frost accumulation thereon. A first header is connected to the circuits of the first coil row and a second header is connected to the circuits of the second coil row. An intermediate header is connected to both the first coil row and the second coil row for directing refrigerant therebetween. A hot gas bypass line controlled by a solenoid valve is mounted between the source of refrigerant to the second header and the intermediate header such that during defrost refrigerant is bypassed directly to the intermediate header. From the intermediate header the refrigerant flows through the first coil row to the first header effecting defrost of the first coil row. During defrost the second coil row is isolated since the same fluid is provided to both the second header and the intermediate header creating no pressure differential to cause flow through the second coil row.

DESCRIPTION OF THE PREFERRED EMBODIMENT

As set forth herein the preferred embodiment will be described in reference to a two row plate fin heat exchanger. It is to be understood that this invention applies to multi-row coils having more coil rows than two and applies to coils of configurations other than disclosed wherein there is a coil row which primarily accumulates frost. It is additionally to be understood that although specific headers are disclosed other combinations are available to accomplish the same result. In addition, the hot gas bypass line is shown connected to the outdoor coil connecting line but would serve equally well connecting the second header to the intermediate header directly.

Figure 2:
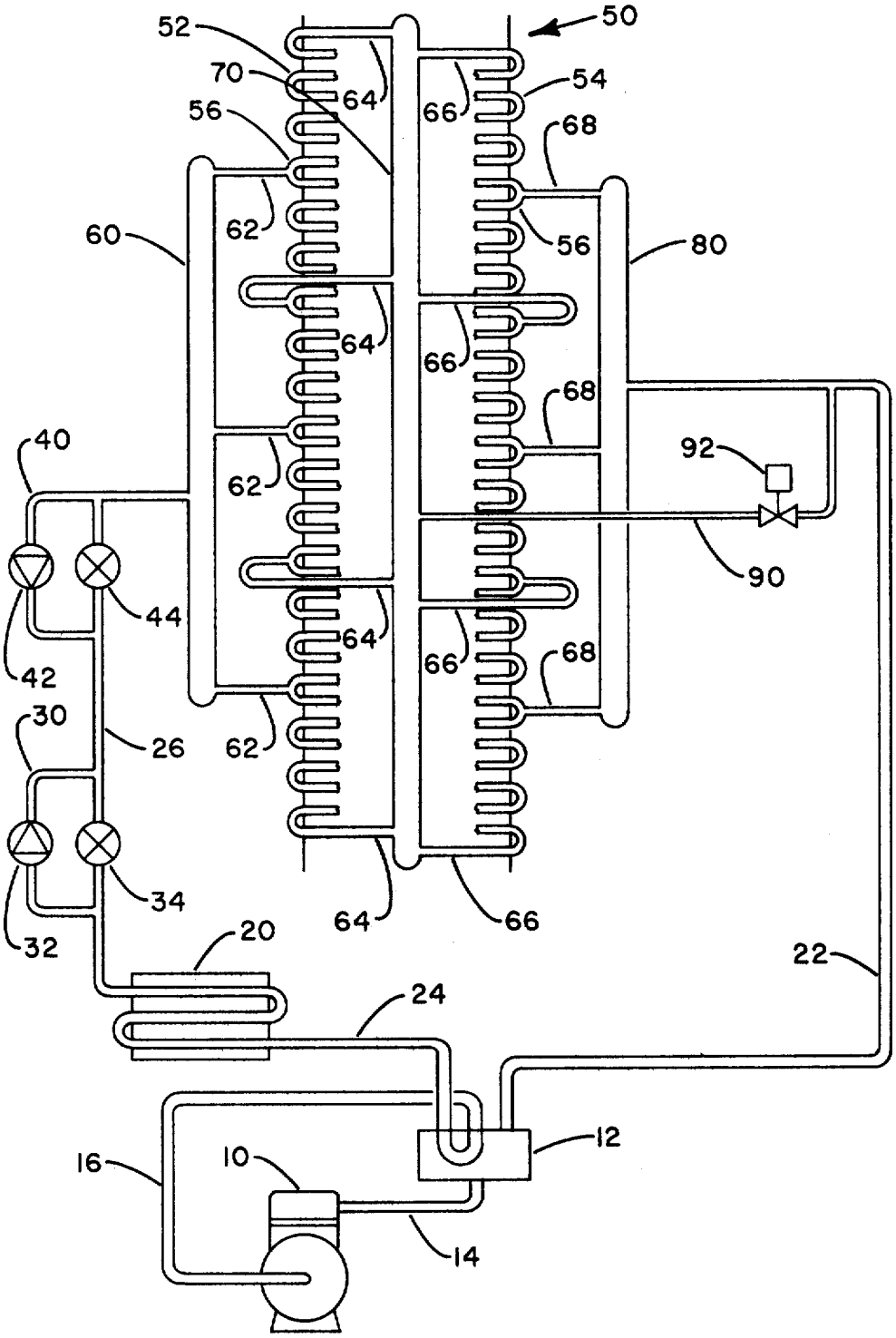
FIG. 2 is a schematic view of a heat pump system having a greatly enlarged outdoor heat exchanger showing the refrigerant flow as set forth herein.

Referring first to FIG. 2 there may be seen a heat pump system including a compressor 10, reversing valve 12, outdoor heat exchanger 50, indoor heat exchanger 20 and expansion means. As shown in FIG. 2, outdoor heat exchanger 50 and its appropriate headering arrangements are greatly enlarged.

Compressor 10 is connected by compressor discharge line 14 and compressor suction line 16 through reversing valve 12. Reversing valve 12 is connected by an outdoor connecting line 22 to second header 80 of outdoor heat exchanger 50 and to the hot gas bypass line 90. Indoor coil connecting line 24 additionally connects reversing valve 12 to indoor heat exchanger 20. Interconnecting line 26 connects indoor heat exchanger 20 to first header 60 of outdoor heat exchanger 50 and includes as a portion thereof expansion means 34 and 44, first bypass 30 having check valve 32 and second bypass 40 having check valve 42.

Outdoor heat exchanger 50 includes a first header 60, second header 80 and intermediate header 70. Outdoor coil row 52 (also referred to as the first coil row) is shown connected to first header 60 via feeder tubes 62 located to join the circuits of the outdoor coil row at selected return bends 56. Similarly, the indoor coil row 54 of the outdoor heat exchanger is connected to second header 80 via feeder tubes 68. Feeder tubes 68 engage the indoor coil row at selected return bends 56 in the indoor coil row 54. Intermediate header 70 is connected by feeder tubes 64 to various portions of outdoor coil row 52 and to various portions of indoor coil row 54 via feeder tubes 66. In addition thereto hot gas bypass line 90 connects outdoor coil connecting line 22 directly to intermediate header 70. Solenoid valve 92 is located to control the flow of refrigerant through hot gas bypass line 90.

Figure 3:
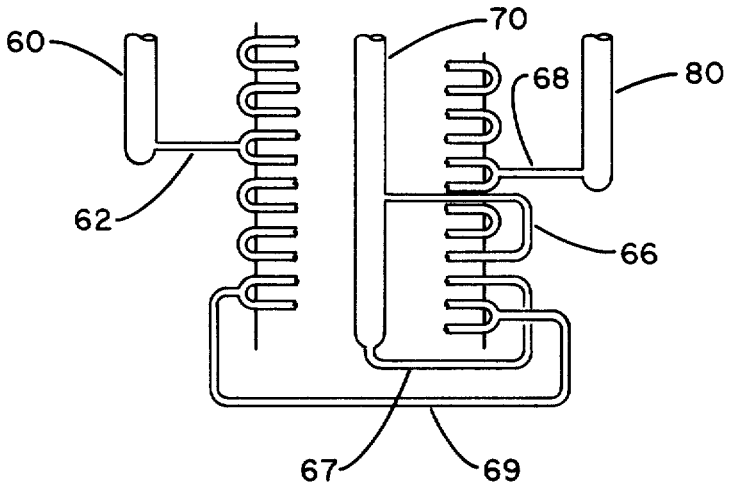
FIG. 3 is a schematic view of the indicated portion of FIG. 2 showing an alternative refrigerant flow path.

An alternative embodiment to the schematical FIG. 2 is shown in FIG. 3. In this embodiment the first coil row includes several serpentine loops at the bottom of indoor row 54 also subject to having frost accumulate thereon. Feeder line 66 connects intermediate header 70 to a return bend of the indoor coil row. Feeder line 67 likewise connects intermediate header 70 to the indoor coil row. Jumper line 69 connects the indoor coil row directly to the outdoor coil row.

Figure 1:
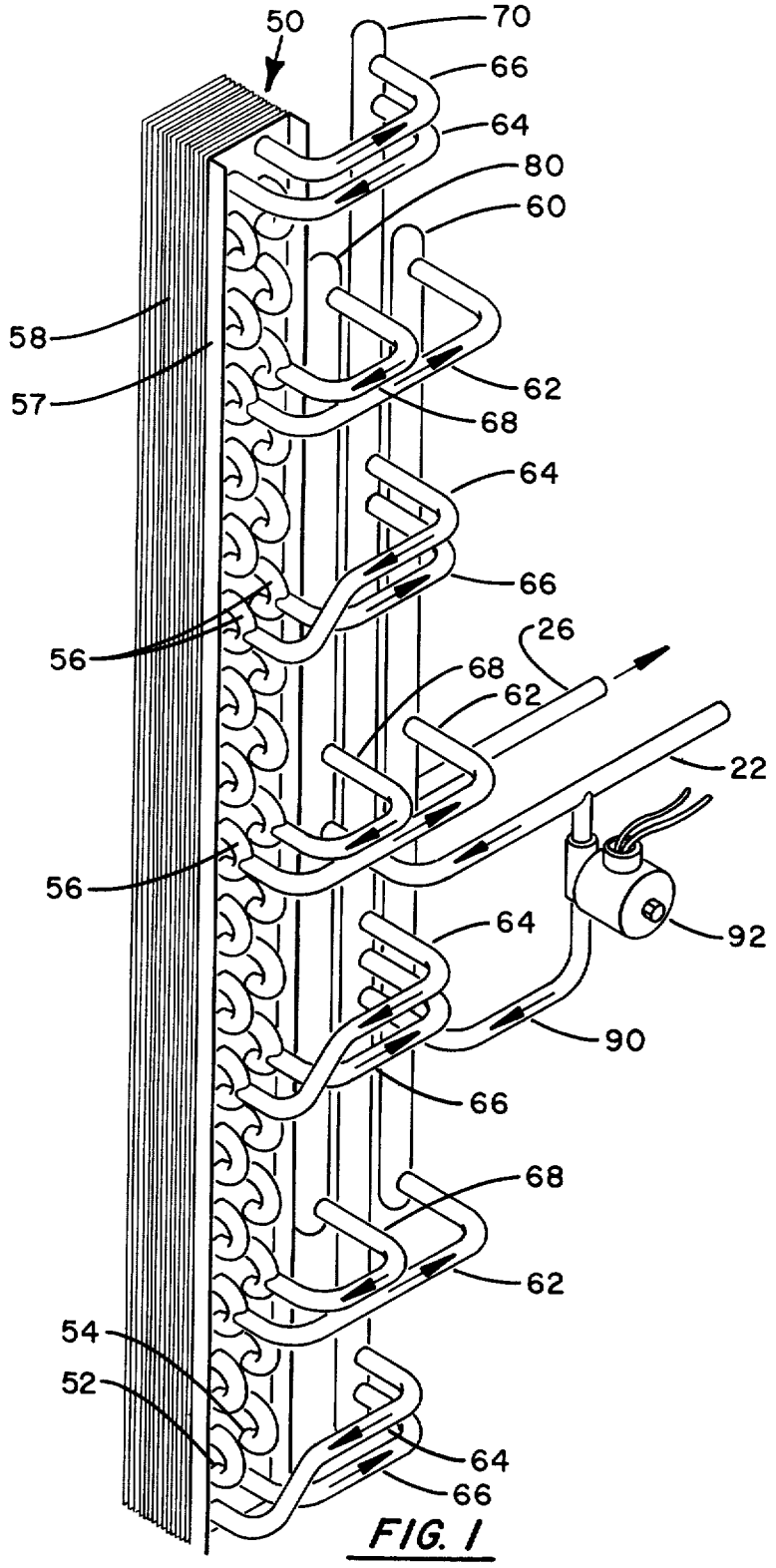
FIG. 1 is an isometric view of the end of a two row heat exchange coil showing three headers.

Referring now to FIG. 1 there may be seen a perspective view of the end of outdoor heat exchanger 50. Fins 58 are shown connected to promote effective heat transfer between hairpin tubes 58 and the air flowing over the heat exchanger. Tube sheet 57 is shown mounted at the ends of a fin bundle formed by fins 58. Return bends 56 extend from the opposite side of the tube sheet from the fins. Some of the return bends are connected to the various headers by feeder tubes. First header 60 is shown connected by feeder tubes 62 to outdoor coil row 52 of the heat exchanger. Second header 80 is shown connected by feeder tubes 68 to the indoor coil row 54 of the heat exchanger. Intermediate header 70 is shown connected by feeder tubes 64 to outdoor coil row 52 and by feeder tubes 66 to indoor coil row 54 of the heat exchanger. It can additionally be seen that interconnecting line 26 connects to first header 60 and that outdoor coil connecting line 22 connects to second header 80. Additionally, hot gas bypass line 90 is shown connecting outdoor coil connecting line 22 to intermediate header 70. Solenoid valve 92 is mounted within hot gas bypass line 90 to regulate the flow of refrigerant therethrough.

OPERATION

When the heat pump is in the cooling mode of operation, as shown in FIG. 2, gaseous refrigerant is directed from the compressor through the reversing valve to the outdoor heat exchanger wherein it is condensed to a liquid. Liquid refrigerant is discharged from the outdoor heat exchanger and flows through expansion device 44 and through check valve 32 to the indoor heat exchanger 20. In the indoor heat exchanger the refrigerant changes state from a liquid to a gas absorbing heat energy from air to be cooled and is returned to the compressor to complete the cycle.

In this cooling mode of operation refrigerant flows through outdoor connecting line 22 to second header 80. From second header 80 refrigerant flows through feeder tubes 68 to return bends 56 of indoor coil row 54. Refrigerant then flows through the refrigerant circuits of indoor coil row 54 to feeder tubes 66 connected to intermediate header 70. From intermediate header 70 refrigerant then flows through feeder tubes 64 to the outdoor coil row 52 of the outdoor heat exchanger. The refrigerant then flows through refrigerant circuits of the outdoor heat exchanger and then through feeder tubes 62 to first header 60 of the outdoor heat exchanger.

In the heating mode of operation refrigerant is directed from the reversing valve to the indoor heat exchanger where it is condensed giving off heat energy to the air to be conditioned. From the indoor heat exchanger refrigerant flows through interconnecting line 26 through expansion valve 34 and through check valve 42 to first header 60. From first header 60 of the outdoor heat exchanger refrigerant flows through the outdoor coil row to the intermediate header, to the indoor coil row, to the second header and through the outdoor coil connecting line back to the reversing valve to complete the circuit. Refrigerant flow through the outdoor heat exchanger 50 in the heating mode is opposite the refrigerant flow therethrough in the cooling mode.

If the heat pump has been operating in the heating mode and the ambient temperature conditions are such that frost has accumulated on outdoor coil row 52 of the heat exchanger, then the heat pump system is operated in the cooling mode to effect defrost of the outdoor heat exchanger. In this mode solenoid 90 is opened allowing hot gaseous refrigerant from the compressor to flow to second header 80 and to intermediate header 70. Since the second or indoor coil row 54 of the outdoor heat exchanger is connected therebetween both sides of the coil row see the same pressure and there is effectively no refrigerant flow therethrough isolating the indoor coil row. Refrigerant flows from the intermediate header 70 through the feeder tubes 64 into the outdoor coil row 52 of the outdoor heat exchanger. The hot gaseous refrigerant therein gives up some of its heat energy to the outdoor coil row melting the frost formed thereon. The refrigerant is then conducted from feeder tubes 62 to first header 60 and through the remainder of the refrigerant circuit as if the heat pump were in the cooling mode of operation.

Defrost operation involving the alternative embodiment as shown in FIG. 3 is similar to the operation as described above. Hot refrigerant is supplied to intermediate header 70 and then flows through the top three feeder tubes 64 to the outdoor row of the heat exchanger. Hot refrigerant additionally flows through feeder tube 67 to the bottom portion of the indoor row of the coil and then through jumper line 69 to feeder tube 62 and first header 60. In this alternative embodiment hot refrigerant is supplied to the bottom several rows of the indoor row as well as the circuits of the outdoor row to defrost the bottom several rows of the indoor coil as well as the circuits of the outdoor coil.

The above described method provides an effective way of directing the hot gaseous refrigerant directly to the outdoor coil row at which the frost has accumulated. By isolating the indoor coil row of the outdoor heat exchanger heat energy is not used to increase the temperature of the non-iced portion of the heat exchanger.

It is to be understood that defrost can be accomplished utilizing a liquid refrigerant rather than a hot gaseous refrigerant and that this application is not limited to a heat pump but includes other applications wherein a heat exchanger may have frost buildup thereon.

It is to be understood that variations and modifications can be effected within the spirit and scope of this invention by those skilled in the art.

What is claimed is:

1. A heat exchanger assembly for transferring heat energy between air flowing over a heat exchanger and fluid flowing through the tubes of the heat exchanger which comprises:

a first coil row having spaced tubes forming at least one fluid flow circuit positioned to receive air flowing over the heat exchanger first;

a second coil row having spaced tubes forming at least one fluid flow circuit positioned to receive air flowing over the heat exchanger after the air has been in heat exchange relation with the first coil row;

a first header connected to the circuits of the first coil row;

a second header connected to the circuits of the second coil row;

an intermediate header connected to both the first coil row and the second coil row to allow fluid flow therebetween; and fluid supply means connected to the second header and the intermediate header, said means including valve means for allowing fluid to flow to both the intermediate header and the second header during defrost.

2. The apparatus as set forth in claim 1 wherein the heat exchanger is a plate fin type heat exchanger including hairpin tubes and return bends affixed to form a serpentine fluid flow path, wherein the first coil row is formed from at least a portion of the serpentine flow path in heat exchange relation with the air as the air first enters the heat exchanger.

3. The apparatus as set forth in claim 1 wherein the fluid supply means comprises a connecting line joined to the second header for supplying fluid thereto, a bypass line joined to the connecting line and the intermediate header, and valve means for controlling flow through the bypass line.

4. The apparatus as set forth in claim 1 and further comprising a jumper conduit connecting a circuit of the first coil row to a circuit of the second coil row whereby the fluid supply means allows refrigerant to flow through circuits in both the first coil row and the second coil row during defrost.

5. A multi-row heat exchanger for use in a refrigeration circuit which comprises:

a first coil row defining at least one refrigerant flow circuit located in heat exchange relation with the ambient air as it enters the heat exchanger;

a second coil row defining at least one refrigerant flow circuit located in heat exchange relation with the ambient air after the air has been in heat exchange relation with the first coil row;

a first header connected to at least a portion of the circuits of the first row;

a second header connected to at least a portion of the circuits of the second row;

an intermediate header connected to at least a portion of the circuits in the first and second rows such that refrigerant flow through the heat exchanger is between the first and second headers through the coil rows and through the intermediate header therebetween; and defrost bypass means for directing refrigerant from the second header directly to the intermediate header thereby isolating the second coil row such that the refrigerant flow is substantially limited to the first coil row.

6. The apparatus as set forth in claim 5 wherein the defrost bypass means comprises a bypass line connecting the intermediate header to the second header and a valve for allowing refrigerant to flow through the bypass line when it is desired to defrost the heat exchanger and for preventing the flow of refrigerant through the bypass line when it is not desired to defrost the heat exchanger.

7. A reversible refrigeration system comprising:

a compressor including compressor discharge and suction lines;

a reversing means connected to a compressor discharge and suction lines;

an indoor heat exchanger connected to the reversing means;

an interconnecting means connected to the indoor heat exchanger and including an expansion means;

an outdoor heat exchanger connected by an outdoor coil connecting line to the reversing means and by the interconnecting means to the indoor heat exchanger, said outdoor heat exchanger further comprising a first coil row located to receive ambient air as it flows through the heat exchanger, at least a second coil row located to receive ambient air after the first coil row, a first header connected to the interconnecting means and the first coil row, a second header connected to the outdoor coil connecting line and the second coil row, an intermediate header connecting the first coil row to the second coil row and bypass means for connecting the outdoor coil connecting line to the intermediate header during defrost to circulate refrigerant received through the first coil row while substantially isolating the second coil row.

8. The apparatus as set forth in claim 7 wherein the bypass means comprises a hot gas bypass line connecting the outdoor coil connecting line to the intermediate header, a valve located to regulate refrigerant flow through the hot gas bypass line whereby when the heat pump is in the defrost mode hot gaseous refrigerant supplied by the compressor is routed through the reversing valve to the outdoor coil connecting line to the intermediate header and then to the first coil row where substantially all the frost buildup has accumulated.

9. A method of controlling the routing of refrigerant through a multi-row heat exchanger to allow for effective heat transfer and to promote rapid defrosting wherein the heat exchanger has multiple coil rows, a first header connected to a first coil row, a second header connected to a second coil row and an intermediate header for connecting the first coil row to the second coil row and wherein frost accumulates primarily on the first coil row which comprises the steps of:

routing the refrigerant between the first and second headers by directing flow through the coil rows and the intermediate header to have effective heat transfer between refrigerant flowing through the heat exchanger and air flowing thereover; and circuiting refrigerant directly to the intermediate header from which it flows through the first coil row to the first header to promote rapid melting of frost accumulated on the first coil row during defrost.

10. The method as set forth in claim 9 wherein the step of circuiting includes isolating the first coil row from refrigerant flow by connecting the first header and the intermediate header to the same refrigerant flow source so there is no pressure differential causing refrigerant to flow through the first coil row.

11. The method as set forth in claim 10 wherein the first coil row is connected directly to the second coil row and wherein the step of circuiting further comprises passing a portion of the refrigerant from the intermediate header through a portion of the second coil row before it flows to the first coil row during defrost.

* * * * *